US007108829B2

(12) United States Patent
Fukuhara et al.

(10) Patent No.: US 7,108,829 B2
(45) Date of Patent: Sep. 19, 2006

(54) METHOD OF MANUFACTURING SLIDING PART AND COMPRESSOR PROVIDED WITH THE SLIDING PART

(75) Inventors: Hiroyuki Fukuhara, Otsu (JP); Hidenobu Shintaku, Otsu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/795,646

(22) Filed: Mar. 8, 2004

(65) Prior Publication Data

US 2004/0179968 A1 Sep. 16, 2004

(30) Foreign Application Priority Data

Mar. 10, 2003 (JP) ..... 2003-063305

(51) Int. Cl.
*B22F 3/24* (2006.01)
*B22F 7/06* (2006.01)

(52) U.S. Cl. ..... 419/6; 419/29

(58) Field of Classification Search ..... 419/6, 419/26, 29
See application file for complete search history.

(56) References Cited

U.S. PATENT DOCUMENTS

| | | | | |
|---|---|---|---|---|
| 4,596,692 | A * | 6/1986 | Morishita et al. | 419/7 |
| 5,087,181 | A * | 2/1992 | Kamitsuma et al. | 418/178 |
| 5,554,338 | A * | 9/1996 | Sugihara et al. | 419/5 |
| 2002/0071781 | A1 * | 6/2002 | Lim et al. | 419/5 |

FOREIGN PATENT DOCUMENTS

| | | |
|---|---|---|
| EP | 1 213 072 | 6/2002 |
| JP | 2002-98052 | 4/2002 |

OTHER PUBLICATIONS

European Search Report corresponding to application No. EP 04 25 1238 dated Mar. 23, 2005.

* cited by examiner

*Primary Examiner*—Ngoclan T. Mai
(74) *Attorney, Agent, or Firm*—RatnerPrestia

(57) ABSTRACT

A method of manufacturing a sliding part includes the steps of forming a green member by injection molding integrally and unmixedly two powdery metallic materials of different compositions, sintering the green member and subjecting the green member to at least one heat treatment.

4 Claims, 5 Drawing Sheets

METHOD OF MANUFACTURING SLIDING PART AND COMPRESSOR PROVIDED WITH THE SLIDING PART

BACKGROUND OF THE INVENTION

1. Field of the Invention

The present invention relates to a method of manufacturing a sliding part and a compressor provided with the sliding part.

2. Description of the Prior Art

FIG. 8 is an exploded perspective view of a known shaft assembly for a compressor. The known shaft assembly includes a sliding part 110, a shaft120 and carbon-based bearings 130 and 140 which are illustrated in FIGS. 9 to 12, respectively. In FIGS. 8 and 9, the sliding part 110 is illustrated exaggeratedly on a larger scale than the remaining parts 120, 130 and 140. As shown in FIG. 9, the sliding part 110 is formed with a through-hole 111 having a flat face 112. As shown in FIG. 10, the shaft 120 includes an eccentric shaft portion 121 disposed at its one end, a flange 123 disposed at its intermediate portion and a stepped shaft portion 124 disposed at the other end. The bearing 130 includes a hub 131 having a bore 132 as shown in FIG. 11, while the bearing 140 has a bore 141 as shown in FIG. 12. The eccentric shaft portion 121 of the shaft 120 is fitted into the through-hole 111 of the sliding part 110 through engagement of a flat face 122 of the eccentric shaft portion 121 of the shaft 120 with the flat face 112 of the sliding part 110 such that the shaft 120 is axially slidable in the through-hole 111 of the sliding part 110. As shown in FIG. 8, the sliding part 110 mounted on the eccentric shaft portion 121 of the shaft 120 is rotatably received by the bore 132 of the bearing 130, while the stepped shaft portion 124 of the shaft 120 is rotatably received by the bore 141 of the bearing 140.

Since the carbon-based bearings 130 and 140 have high hardness, wear resistance is required of the sliding part 110 and the shaft 120 which are, respectively, fitted into the bores 132 and 141 of the bearings 130 and 140, so that surfaces of the sliding part 110 and the shaft 120 should have an extremely high Vickers hardness Hv of not less than 1000 as disclosed in, for example, Japanese Patent Laid-Open Publication No. 2002-98052. Since range of choice of materials and treatments for obtaining such hard surfaces is quite narrow, the sliding part 110 and the shaft 120 are quite often manufactured by employing an identical material and an identical treatment.

However, in the known shaft assembly of the above arrangement, since the flat face 122 of the eccentric shaft portion 121 of the shaft 120 and the flat face 112 of the sliding part 110, which are brought into engagement with each other, are made of the identical material and are subjected to the identical treatment and thus, have identical surface properties, thereby resulting in possible occurrence of seizing therebetween. If lubricating oil is supplied to the flat face 122 of the shaft 120 and the flat face 112 of the sliding part 110 in order to prevent such an accident, a lubricating mechanism is required to be provided additionally, so that the known shaft assembly becomes complicated structurally and thus, it becomes difficult to manufacture the known shaft assembly at low cost. Meanwhile, if one of the flat face 122 of the shaft 120 and the flat face 112 of the sliding part 110 is subjected to coating such as physical vapor deposition (PVD) so as to make surface properties of the one of the flat face 122 of the shaft 120 and the flat face 112 of the sliding part 110 different from those of the other of the flat face 122 of the shaft 120 and the flat face 112 of the sliding part 110, the coating cost rises, so that it also becomes difficult to manufacture the known shaft assembly at low cost.

SUMMARY OF THE INVENTION

Accordingly, an essential object of the present invention is to provide, with a view to eliminating the above mentioned drawbacks of prior art, a sliding part which is inexpensive and wear-resistant.

In order to accomplish this object of the present invention, a method of manufacturing a sliding part includes the step of forming a green member by injection molding integrally and unmixedly two powdery metallic materials of different compositions. Then, the method includes the step of sintering the green member. Subsequently, the method includes the step of subjecting the green member to at least one heat treatment.

In accordance with the present invention, since the finished sliding part includes one portion and the other portion having the different compositions, respectively, there is a proper difference between hardness of a surface of the one portion of the finished sliding part and that of the other portion of the finished sliding part, so that wear resistance is secured by difference in hardness between the one portion of the sliding part and a mating part and between the other portion of the sliding part and a further mating part. Therefore, it becomes possible to eliminate such inconveniences as seizing of fitting surfaces between the one portion of the sliding part and the mating part and between the other portion of the sliding part and the further mating part, an expensive mechanism and an expensive treatment.

BRIEF DESCRIPTION OF THE DRAWINGS

This object and features of the present invention will become apparent from the following description taken in conjunction with the preferred embodiment thereof with reference to the accompanying drawings in which.

Before the description of the present invention proceeds, it is to be noted that like parts are designated by like reference numerals throughout several views of the accompanying drawings.

DETAILED DESCRIPTION OF THE INVENTION

Figure 1:
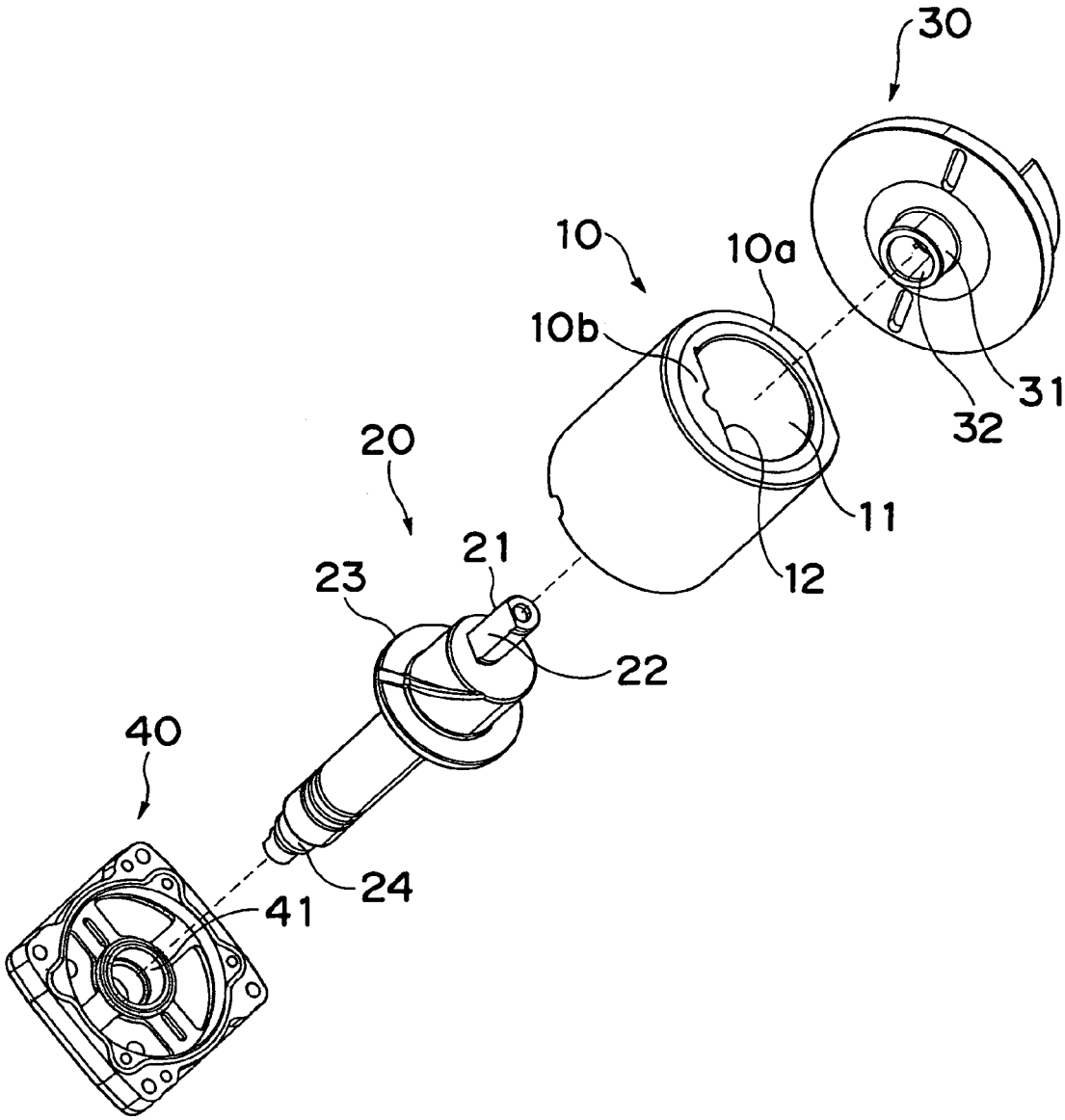
FIG. 1 is an exploded perspective view of a shaft assembly for a compressor, which includes a sliding part according to one embodiment of the present invention.
Figure 2:
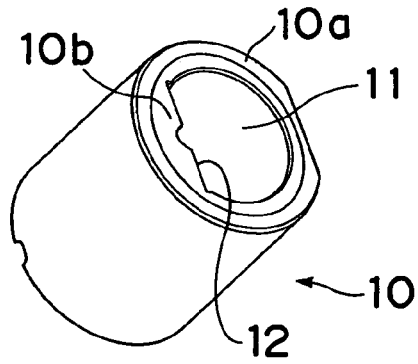
FIG. 2 is a perspective view of the sliding part of FIG. 1.
Figure 3:
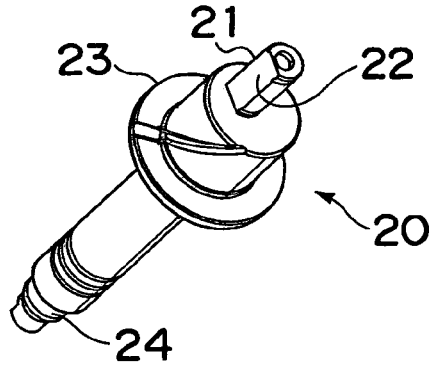
FIG. 3 is a perspective view of a shaft employed in the shaft assembly of FIG. 1.
Figure 4:
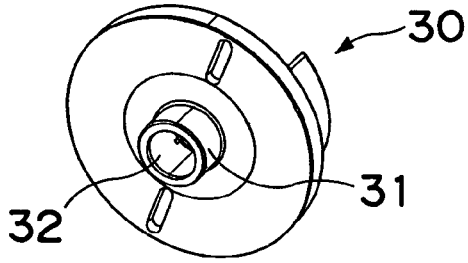
FIG. 4 is a perspective view of a bearing employed in the shaft assembly of FIG. 1.
Figure 5:
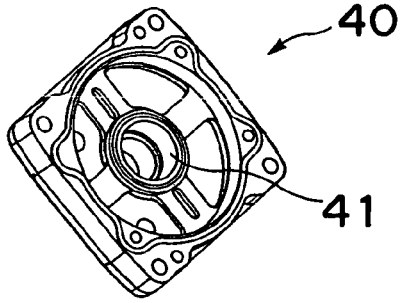
FIG. 5 is a perspective view of a further bearing employed in the shaft assembly of FIG. 1.

FIG. 1 is an exploded perspective view of a shaft assembly for a compressor, which includes a sliding part 10 according to one embodiment of the present invention. The shaft assembly includes the sliding part 10, a shaft 20 and carbon-based bearings 30 and 40 which are shown in FIGS. 2 to 5, respectively. In FIGS. 1 and 2, the sliding part 10 of the present invention is illustrated exaggeratedly on a larger scale than the remaining parts 20, 30 and 40. As shown in FIG. 2, the sliding part 10 is formed with a through-hole 11 having a flat face 12. As shown in FIG. 3, the shaft 20 includes an eccentric shaft portion 21 disposed at its one end, a flange 23 disposed at its intermediate portion and a stepped shaft portion 24 disposed at the other end. The bearing 30 includes a hub 31 having a bore 32 as shown in FIG. 4, while the bearing 40 has a bore 41 as shown in FIG. 5. The eccentric shaft portion 21 of the shaft 20 is fitted into the through-hole 11 of the sliding part 10 through engagement of a flat face 22 of the eccentric shaft portion 21 of the shaft 20 with the flat face 12 of the sliding part 10 such that the shaft 20 is axially slidable in the through-hole 11 of the sliding part 10. As shown in FIG. 1, the sliding part 10 mounted on the eccentric shaft portion 21 of the shaft 20 is rotatably slidable in the bore 32 of the bearing 30, while the stepped shaft portion 24 of the shaft 20 is rotatably slidable in the bore 41 of the bearing 40.

As shown in FIG. 2, the sliding part 10 further includes an outer peripheral portion 10*a* and an inner peripheral portion 10*b*. The outer peripheral portion 10*a* of the sliding part 10 is rotatably received by the bore 32 of the carbon-based bearing 30 and thus, should have a Vickers hardness Hv of not less than 1000 so as not to be worn by the carbon-based bearing 30. Meanwhile, since the eccentric shaft portion 21 of the shaft 20 is axially slidably fitted into the through-hole 11 of the inner peripheral portion 10*b* of the sliding part 10 and the stepped shaft portion 24 is rotatably received by the bore 41 of the carbon-based bearing 40, the shaft 20 also should have a Vickers hardness Hv of not less than 1000 so as to have wear resistance in the same manner as the sliding part 10.

As a stock of the sliding part 10, a green member in which the outer peripheral portion 10*a* and the inner peripheral portion 10*b* are, respectively, formed by powdery stainless steel of "SUS420J2" in Japanese Industrial Standards (JIS) and powdery chromium molybdenum steel of "SCM415" in JIS integrally and unmixedly is formed by injection molding. Then, the stock is sintered. After rough machining, this stock is subjected to carburized hardening at 930° C. for 3 hr., tempering at 160° C. and nitriding at 590° C. for 27 hr.

Figure 6:
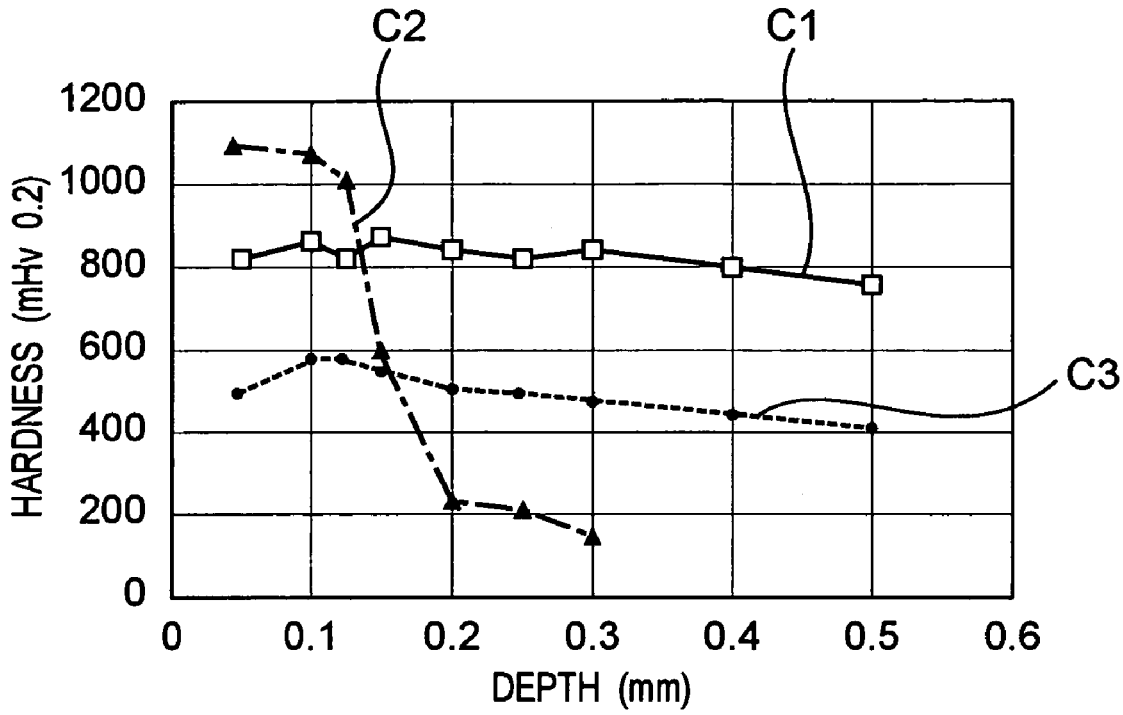
FIG. 6 is a graph indicative of distribution of hardness in the sliding part of FIG. 1.

In FIG. 6, after carburized hardening, hardness of an inner peripheral surface of the inner peripheral portion 10*b* made of SCM415 is as high as a Vickers hardness of about 850 as indicated by the curve C1. Meanwhile, after nitriding, hardness of an outer peripheral surface of the outer peripheral portion 10*a* made of SUS420J2 is as high as a Vickers hardness Hv of about 1200 as indicated by the curve C2 and the inner peripheral surface of the inner peripheral portion 10*b* in a tempered state assumes a Vickers hardness of about 600 as indicated by the curve C3. After these heat treatments, the stock is subjected to finish machining at a depth of cut of about 0.05 mm. Thus, manufacture of the sliding part 10 is completed.

Figure 7:
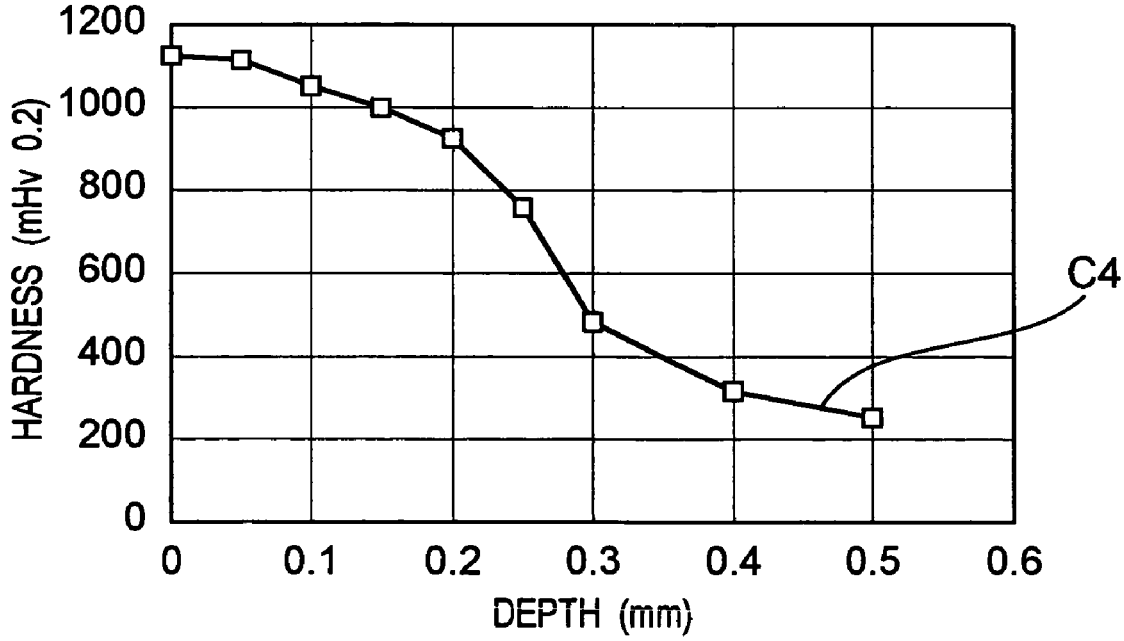
FIG. 7 is a graph indicative of distribution of hardness in the shaft of FIG. 3.
Figure 8:
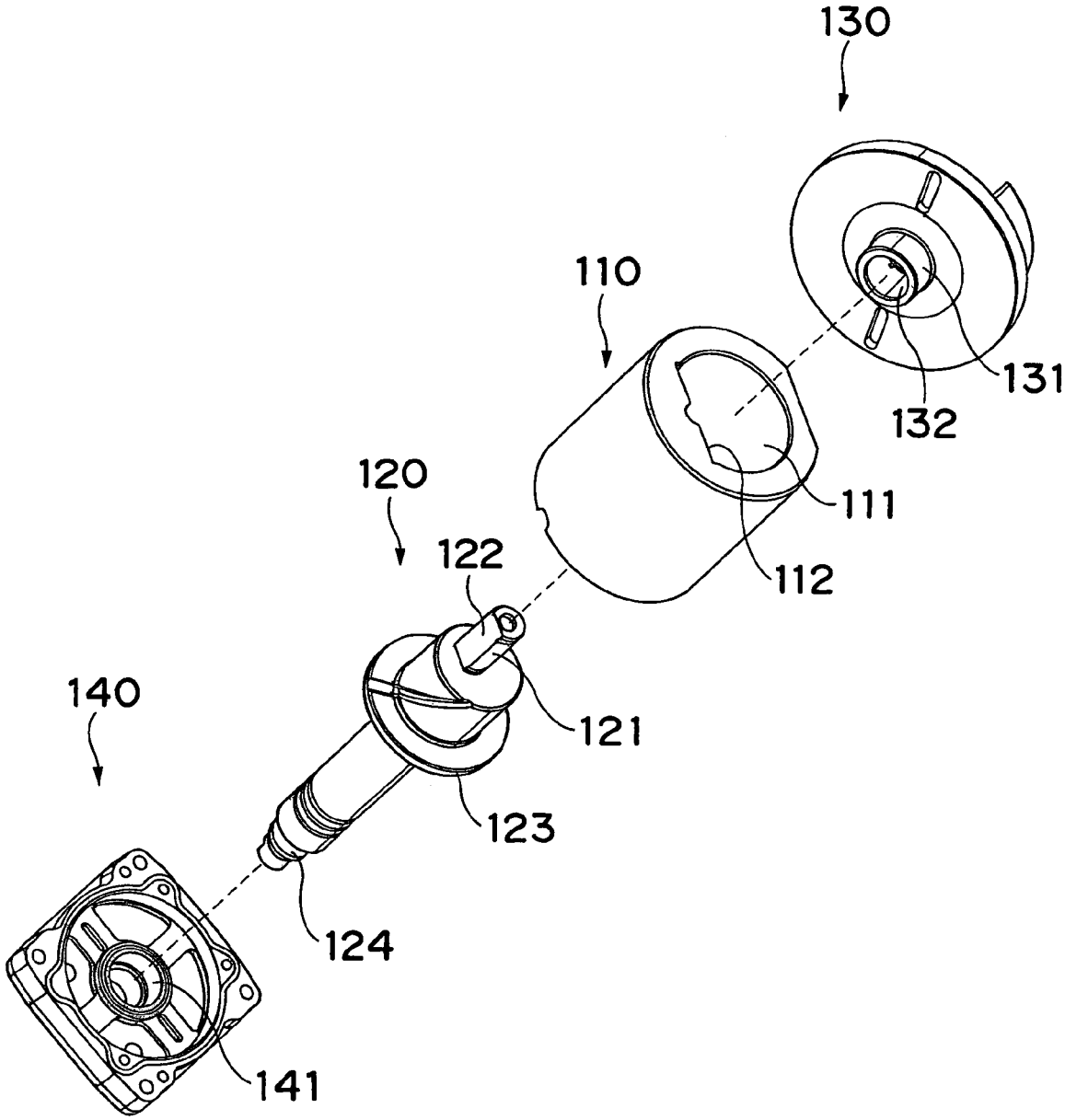
Fig. 8 PRIOR ART
FIG. 8 is an exploded perspective view of a prior art shaft assembly for a compressor.
Figure 9:
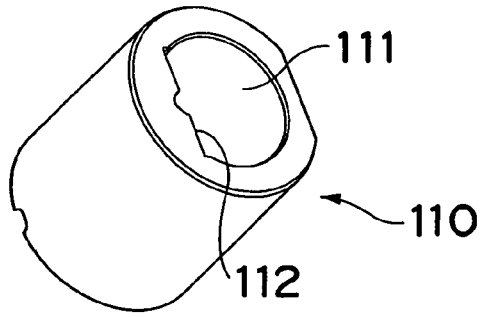
Fig. 9 PRIOR ART
FIG. 9 is a perspective view of a sliding part employed in the prior art shaft assembly of FIG. 8.
Figure 10:
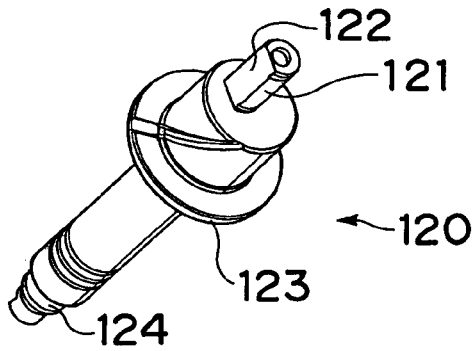
Fig. 10 PRIOR ART
FIG. 10 is a perspective view of a shaft employed in the prior art shaft assembly of FIG. 8.
Figure 11:
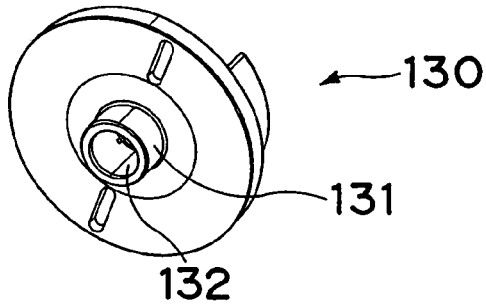
Fig. 11 PRIOR ART
FIG. 11 is a perspective view of a bearing employed in the prior art shaft assembly of FIG. 8.
Figure 12:
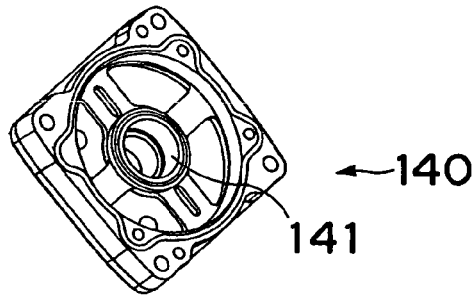
Fig. 12 PRIOR ART
FIG. 12 is a perspective view of a further bearing employed in the prior art shaft assembly of FIG. 8.

A stock of the shaft 20 which is axially slidably engageable with this sliding part 10 is made of aluminum chromium molybdenum steel of "SACM645" in JIS and is subjected to rough machining and nitriding at 510° C. for 48 hr. This stock of the shaft 20 assumes a Vickers hardness Hv of about 1000 even at a depth of 0.1 mm from the surface as indicated by the curve C4 in FIG. 7. After nitriding, the stock is subjected to finish machining at a depth of cut of 0.05 to 0.1 mm. Thus, manufacture of the shaft 20 is completed. Even the finished shaft 20 has a Vickers hardness of about 1000.

Since there is a difference in hardness between the flat face 12 of the sliding part 10 having a Vickers hardness Hv of about 600 and the flat face 22 of the shaft 20 having a Vickers hardness Hv of about 1000, the flat face 12 of the sliding part 10 and the flat face 22 of the shaft 20, which are engageable with each other, do not wear, so that operational reliability of the sliding part 10 and the shaft 20 can be secured.

In this embodiment, the stock of the sliding part 10 is formed by the outer peripheral portion 10*a* made of SUS420J2 and the inner peripheral portion 10*b* made of SCM415 and is subjected to such heat treatments as carburized hardening and nitriding. Meanwhile, according to JIS, stainless steel of SUS420J2 for the outer peripheral portion 10*a* contains 12.00 to 14.00% by weight of chromium and chromium molybdenum steel of SCM415 for the inner peripheral portion 10*a* contains 0.90 to 1.20% by weight of chromium. Thus, by eliminating carburized hardening, only nitriding may also be performed such that the outer peripheral portion 10*a* and the inner peripheral portion 10*b* of the sliding part 10 after nitriding assume a Vickers hardness of about 1200 and a Vickers hardness of about 700, respectively due to difference in chromium content therebetween.

Meanwhile, in this embodiment, the sliding part 10 is rotatably slidable in the bore 32 of the bearing 30. However, the present invention may also be applicable to a case in which the sliding part 10 slidably reciprocates in the bore 32 of the bearing 30.

Furthermore, in case the sliding part 10 is used for the compressor, the sliding part 10 may be used for various kinds of compressors of scroll type, rolling piston type, etc., so that the compressors have simple structure and are made inexpensive and highly reliable.

As is clear from the foregoing description, since the method of manufacturing the sliding part, according to the present invention includes the steps of forming the green member by injection molding integrally and unmixedly the two powdery metallic materials of the different compositions, sintering the green member and subjecting the green member to at least one heat treatment, hardness of the one portion of the finished sliding part is different from that of the other portion of the finished sliding part, so that compatibility of the one portion and the other portion of the finished sliding part with the respective mating parts is upgraded easily and thus, the sliding part is made highly reliable.

Meanwhile, by using this sliding part for the compressor, the compressor is also made highly reliable.

What is claimed is:

1. A method of manufacturing a sliding part, comprising the steps of:

forming a green member by injection molding integrally and unmixedly a first iron series powdery metallic alloy containing less than 6% by weight of chromium and a second iron series powdery metallic alloy containing not less than 6% by weight of chromium;

sintering the green member; and subjecting the green member to at least one heat treatment.

2. The method as claimed in claim 1, wherein the heat treatment includes hardening and nitriding.

3. The method as claimed in claim 1, wherein the heat treatment is nitriding.

4. A method of manufacturing a sliding part according to claim 1, wherein said first and second alloys are formed integrally with each other in an unmixed state.

* * * * *